US011192617B1

(12) United States Patent
Colbert

(10) Patent No.: US 11,192,617 B1
(45) Date of Patent: Dec. 7, 2021

(54) WATERCRAFT COOLER SYSTEM

(71) Applicant: Todd Colbert, Dunedin, FL (US)

(72) Inventor: Todd Colbert, Dunedin, FL (US)

( * ) Notice: Subject to any disclaimer, the term of this patent is extended or adjusted under 35 U.S.C. 154(b) by 0 days.

(21) Appl. No.: 16/924,250

(22) Filed: Jul. 9, 2020

Related U.S. Application Data

(60) Provisional application No. 62/871,767, filed on Jul. 9, 2019.

(51) Int. Cl.
*B63B 34/10* (2020.01)

(52) U.S. Cl.
CPC ..... *B63B 34/10* (2020.02)

(58) Field of Classification Search
CPC ..... B63B 34/10
See application file for complete search history.

(56) References Cited

U.S. PATENT DOCUMENTS 4,909,176 A * 3/1990 Kobayashi ..... B63B 34/10 114/343
5,915,329 A * 6/1999 Watkins ..... B63B 34/10 114/363
6,035,800 A * 3/2000 Clifford ..... B63B 25/002 114/347
6,276,290 B1 * 8/2001 Yamada ..... B63B 19/14 114/55.51
D703,007 S * 4/2014 McCarthy ..... D7/605
9,365,268 B1 * 6/2016 Paccoud ..... B63B 59/02
2005/0006167 A1 * 1/2005 Bertrand ..... B62K 19/46 180/290
2015/0336634 A1 * 11/2015 Swan ..... B63B 7/082 114/345
2018/0274837 A1 * 9/2018 Christensen ..... A47G 23/02
2021/0197936 A1 * 7/2021 McNaughton ..... B63B 43/06

* cited by examiner

*Primary Examiner* — S. Joseph Morano
*Assistant Examiner* — Jovon E Hayes
(74) *Attorney, Agent, or Firm* — Lewellyn Law, PLLC; Stephen Lewellyn

(57) ABSTRACT

A personal watercraft has laterally spaced foot channels, a passenger seat, an engine compartment, and a back end. A receiver is universally positioned within the foot channels adjacent to the back end. A support member with a cylindrical knuckle and a strap is positioned within the engine compartment below the passenger seat thereby positioning a secondary end of the strap exteriorly of the engine compartment adjacent to the receiver. An insulated container with a closed bottom and an open top is removably positioned within the receiver. A lid is operably coupled to the open top. The receiver has a primary arm with a primary suction cup and a secondary arm with a secondary suction cup. The primary and secondary suction cups are provided for parallel alignment and vertical engagement with an exterior surface of the engine compartment.

8 Claims, 6 Drawing Sheets

FIG. 1
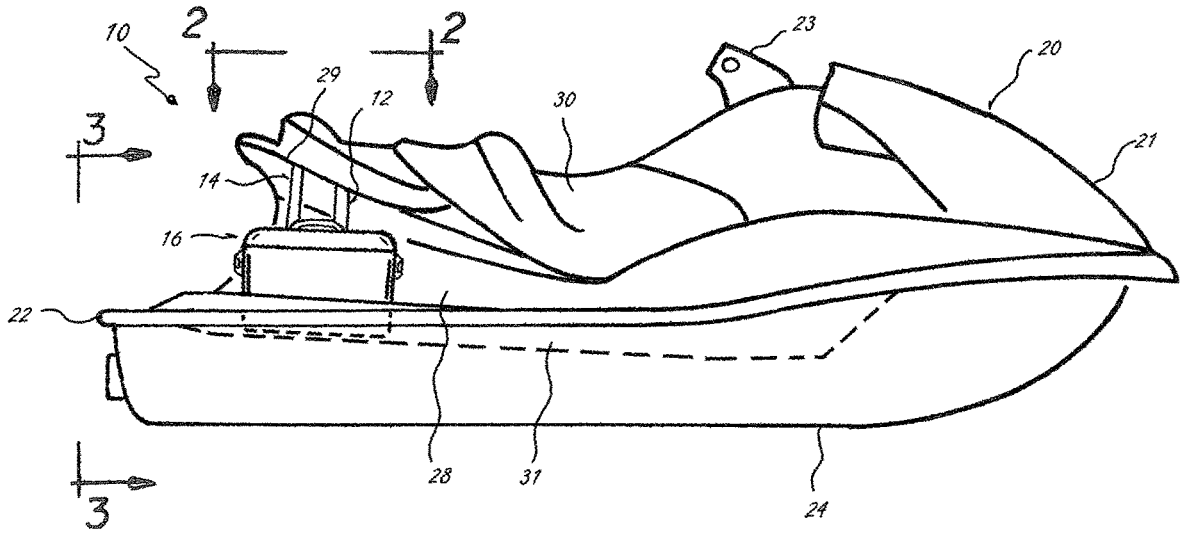
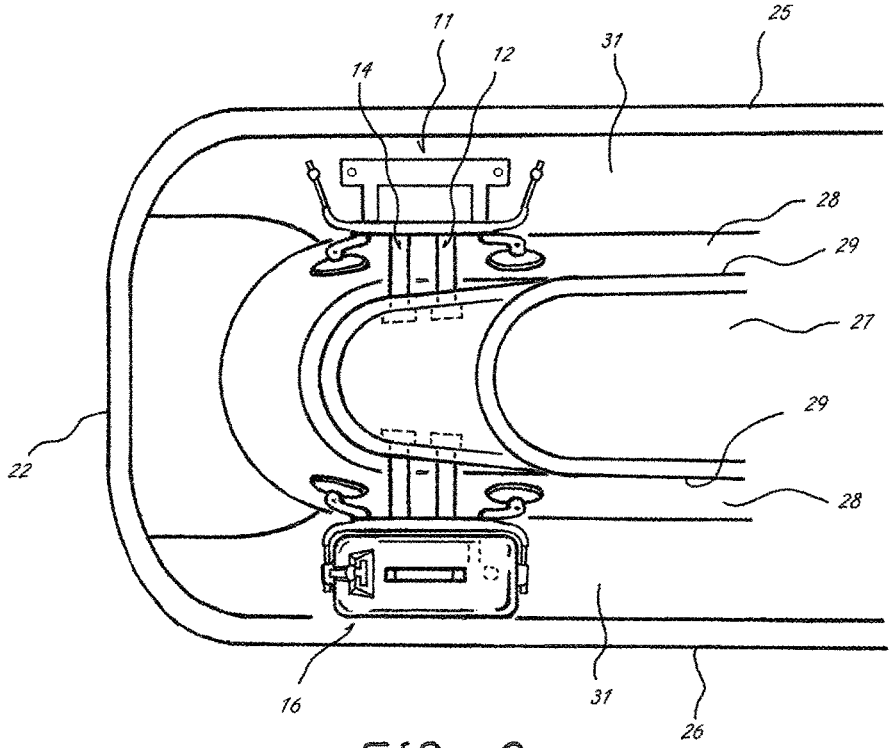
FIG. 2

FIG. 5
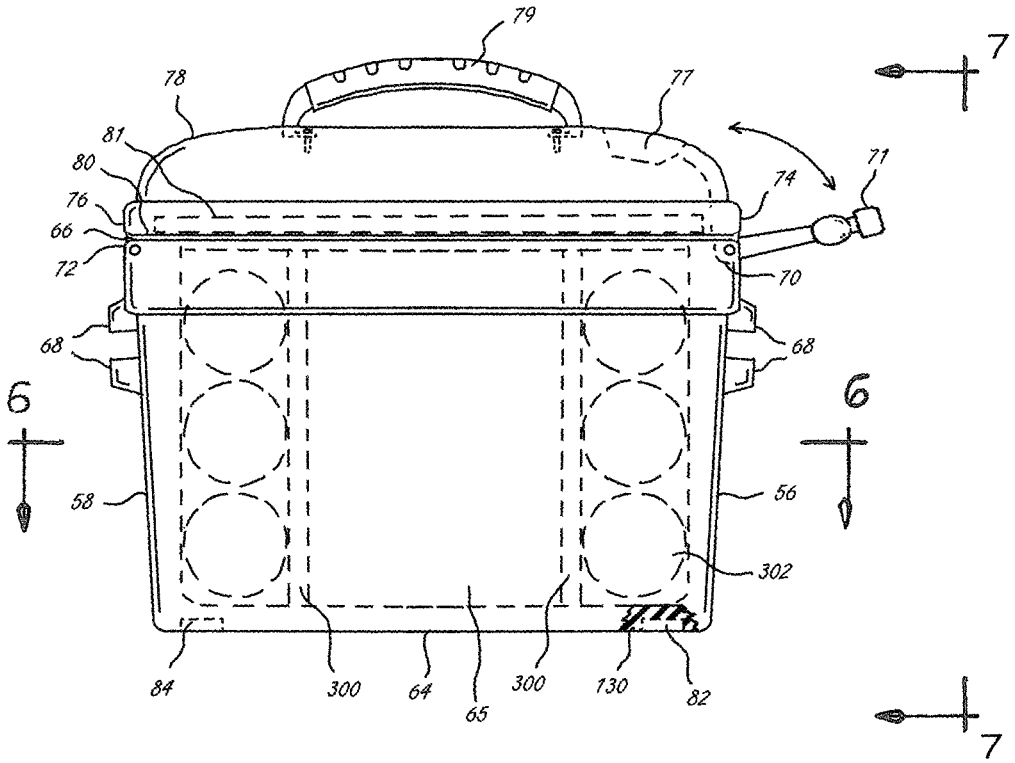
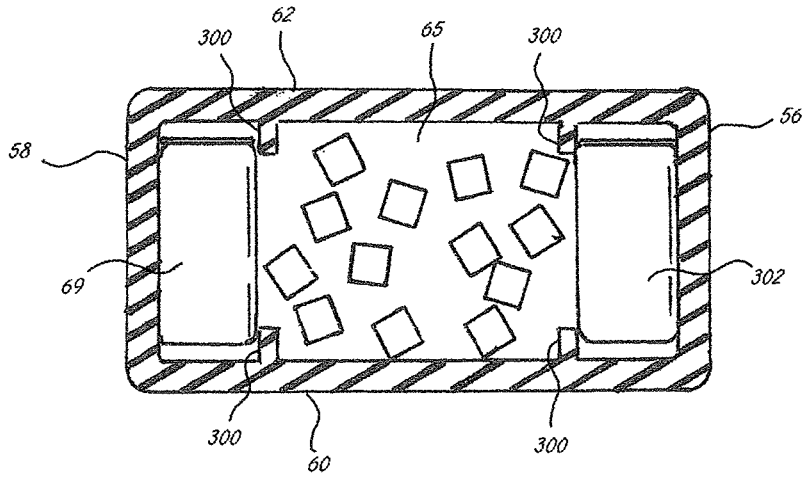
FIG. 6

FIG. 9
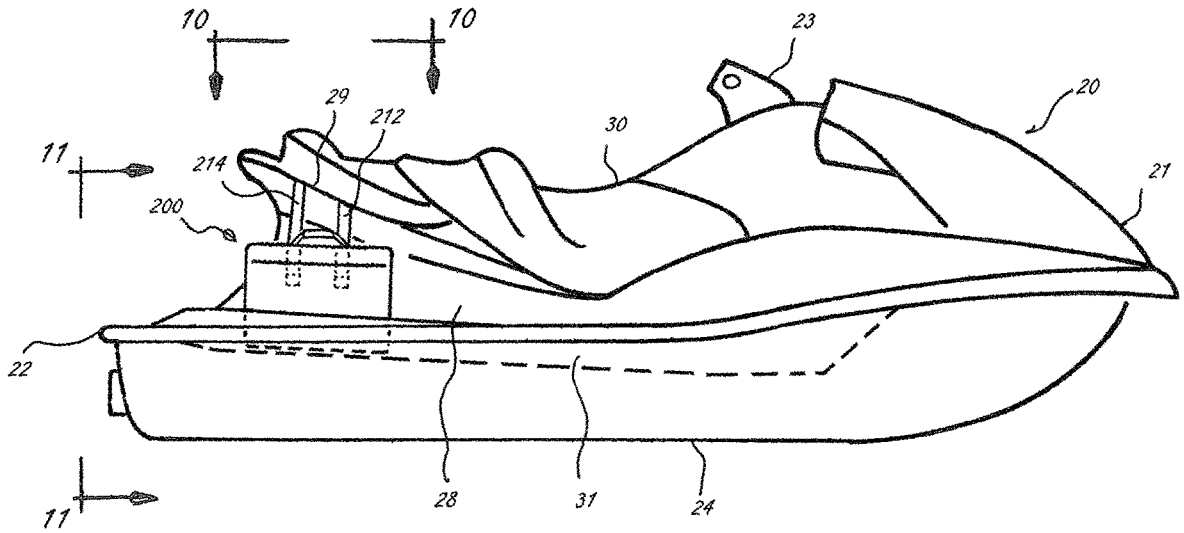
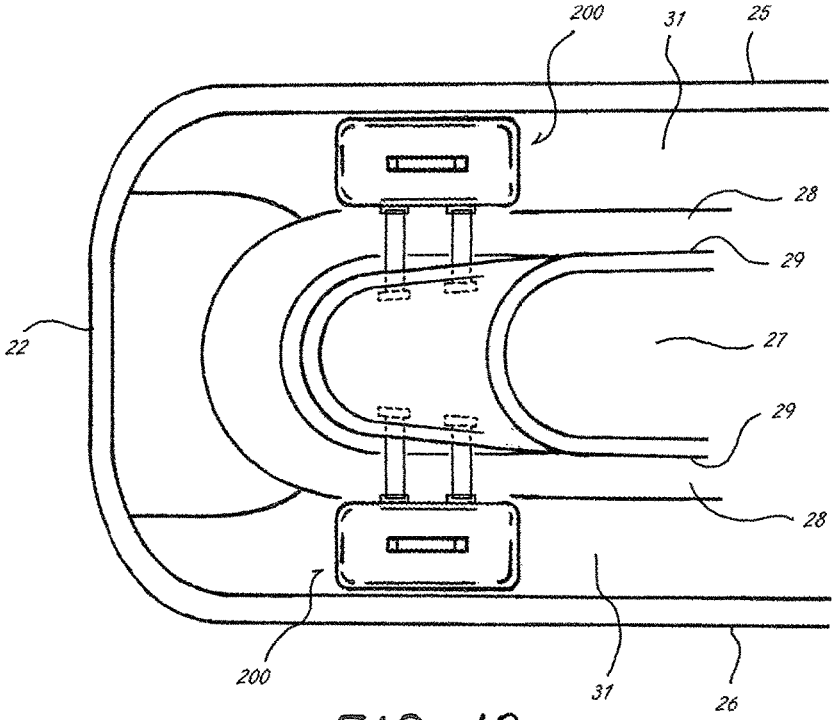
FIG. 10

WATERCRAFT COOLER SYSTEM

CROSS-REFERENCE TO RELATED APPLICATIONS

This application claims the benefit of U.S. Provisional Application Ser. No. 62/871,767, filed Jul. 9, 2019, the entirety of which is incorporated herein by reference.

BACKGROUND OF THE INVENTION

Field of the Invention

The present invention relates to an insulated cooler which is supported and mounted to a watercraft. More specifically, the present invention pertains to a cooler system adapted for containing beverages and other dry goods and which is removably supported and universally mounted within the rearward foot channels of a personal watercraft. The containing, supporting, and mounting are done in a safe, convenient, and economical manner.

Description of the Prior Art

The use of insulated coolers which are made of various materials for containing beverages and other consumer goods are known in the prior art. More specifically, there are also various cooler mounting apparatuses that are well known in the prior art which are previously devised and utilized for the purpose of mounting and securing a cooler to the exterior of a watercraft. Such insulated coolers and cooler mounting apparatuses are known to consist basically of familiar, expected, and obvious structural configurations, notwithstanding the myriad of designs encompassed by the crowded prior art which has been developed for the fulfillment of countless objectives and requirements.

While these known insulated coolers and cooler mounting apparatuses fulfill their respective, particular objectives and requirements of beverage containment and mounting to watercrafts, they do not describe a watercraft cooler system for removably supporting and universally mounting a cooler within the rearward foot channels of a personal watercraft. Furthermore, such insulated coolers and cooler mounting apparatuses of the prior art are comprised of multiple components which are problematic for users attempting to mount a cooler securely to a watercraft. It is known that these other cooler mounting apparatuses do provide an obvious method of attaching an insulated cooler to a watercraft which does allow a user to operate the watercraft while transporting the cooler. However, the designs and methods of attachment to a watercraft, which these other cooler mounting apparatuses utilize, are known to limit accessibility to contents within the insulated cooler while mounted and are further known to be difficult for a user to remove a mounted cooler from the mounting apparatus.

In this respect, the watercraft cooler system according to the present invention substantially departs from the conventional concepts and designs of the prior art, and in doing so provides a system which can be removably supported and universally mounted within the rearward foot channels of a personal watercraft thus providing a multitude of user benefits. Such user benefits primarily range from providing convenient accessibility to contents contained within the system to providing a simple, yet practical method for mounting the system to a personal watercraft.

Therefore, it can be appreciated that there exists a continuing need for a new and improved watercraft cooler system which is removably supported and universally mounted within the rearward foot channels of a personal watercraft for containing beverages and other dry goods in an insulated cooler. In this regard, the present invention substantially fulfills this need.

SUMMARY OF THE INVENTION

In view of the disadvantages inherent in the known types of other coolers and mounting apparatuses of known designs and configurations now present in the prior art, the present invention provides an improved watercraft cooler system. As such, the general purpose of the present invention, which will be described subsequently in greater detail, is to provide a new and improved watercraft cooler system which has all the advantages of the prior art and none of the disadvantages.

To attain this, from a broad perspective, the present invention includes a first support member with a first knuckle and a first strap. The first strap has a primary end and a secondary end with an intermediate region therebetween. The primary end of the first strap terminates within the first knuckle.

container has a first, a second, a third, and a fourth wall which form a generally rectangular shape. The container further has a closed bottom and an open top. The first and second walls have U-shaped projections. The first wall has an upper recess adjacent to the open top. A first latch is positioned within the upper recess. The second wall has a hinge adjacent to the open top. The closed bottom has a forward recess and a similarly configured rearward recess.

lid is positioned above the open top of the container and is operably coupled to the hinge. The lid has a closure recess laterally spaced from the hinge which is disposed for receiving the first latch. The lid further has an exterior surface with a handle.

receiver has an upward support and a horizontal base. The upward support has an interior surface, an exterior surface, a top edge, and a bottom edge. The upward support further has a forward end and a spaced rearward end. The forward and rearward ends each have a distal end curving inwardly towards the interior surface. A second latch is fixed to the distal end of the forward end and a third latch is fixed to the distal end of the rearward end. The top edge has a first rectilinear slot. The horizontal base has a forward region with a forward projection and a rearward region with a rearward projection.

Two laterally spaced L-shaped extents connect the bottom edge of the upward support to the horizontal base. A plurality of apertures extend through an exterior surface and an interior surface of each L-shaped extent.

primary arm has a first end and a second end with a joint therebetween. The first end is adjustably coupled with the plurality of apertures of the L-shaped extent adjacent to the forward region of the horizontal base. A primary suction cup is rotatably mounted to the second end of the primary arm.

secondary arm has a first end and a second end with a joint therebetween. The first end is adjustably coupled with the plurality of apertures of the L-shaped extent adjacent to the rearward region of the horizontal base. A secondary suction cup is rotatably mounted to the second end of the secondary arm.

A personal watercraft has a front end, a back end, a top end, and a bottom end. The personal watercraft further has an engine compartment which is formed above the bottom end and adjacent to the back end. The engine compartment has an exterior surface and an upper periphery. A passenger seat is removably positioned above the engine compartment. Left and right foot channels are laterally spaced and parallel with the passenger seat.

The receiver is positioned within the foot channels of the personal watercraft with the exterior surface of the upward support adjacent to the engine compartment. The first knuckle is positioned within the engine compartment with the intermediate region of the first strap positioned above the upper periphery and below the passenger seat thereby positioning the secondary end of the first strap exteriorly of the engine compartment adjacent to the receiver. The forward and rearward recesses of the container are disposed to receive the forward and rearward projections of the receiver. The U-shaped projection of the first wall is disposed to receive the second and third latches respectively. The U-shaped projection of the second wall is disposed to receive the second and third latches respectively. The first rectilinear slot is disposed to receive the secondary end of the first strap thereby supporting the receiver along the exterior surface of the engine compartment.

There has thus been outlined, rather broadly, the more important features of the invention in order that the detailed description thereof that follows may be better understood and in order that the present contribution to the art may be appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the invention be regarded as including such equivalent constructions insofar as they do not depart from the spirit and scope of the present invention.

It is therefore an object of the present invention to provide a new and improved watercraft cooler system which has all the advantages of the prior cooler mounting apparatuses of known designs and configurations and none of the disadvantages.

It is another object of the present invention to provide a new and improved watercraft cooler system which may be easily and efficiently manufactured and marketed.

It is a further object of the present invention to provide a new and improved watercraft cooler system which is of constructed of durable and reliable materials.

An even further object of the present invention is to provide a new and improved watercraft cooler system which is susceptible of a low cost of manufacture with regard to both materials and labor, and which accordingly is then susceptible of low prices of sale to the consuming public, thereby making such watercraft cooler system economically available.

Lastly, it is an object of the present invention to provide a watercraft cooler system for containing beverages and other dry goods in an insulated cooler which is removably supported and universally mounted within the rearward foot channels of a personal watercraft. The containing, the supporting, and the mounting are done in a safe, convenient, and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of the watercraft cooler system constructed in accordance with the principles of the present invention.

FIG. 2 is a plan view of the system taken along lines 2-2 of FIG. 1.

FIG. 5 is a is a side elevational view of the container taken along lines 5-5 of FIG. 3.

FIG. 6 is a cross sectional view taken along lines 6-6 of FIG. 5.

FIG. 9 is a side elevational view similar to FIG. 1 showing a first alternate embodiment of the system.

FIG. 10 is a plan view of the first alternate embodiment taken along lines 10-10 of FIG. 9.

The same reference numerals refer to the same parts throughout the various Figures.

DETAILED DESCRIPTION OF THE INVENTION

Figure 3:
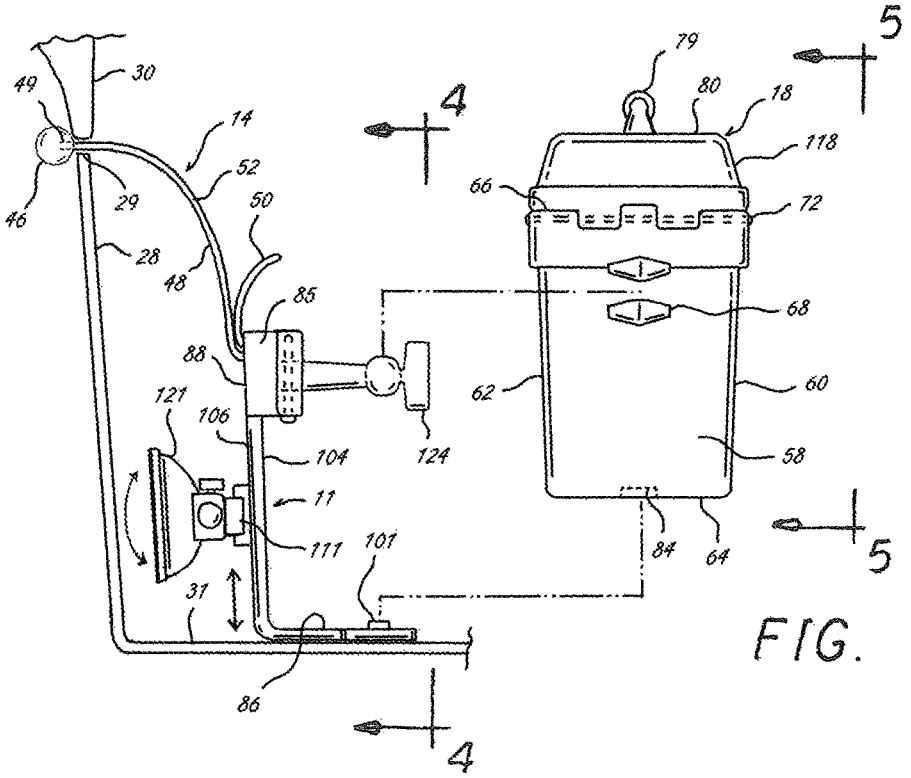
FIG. 3 is a rear elevational view of the system taken along lines 3-3 of FIG. 1.
Figure 4:
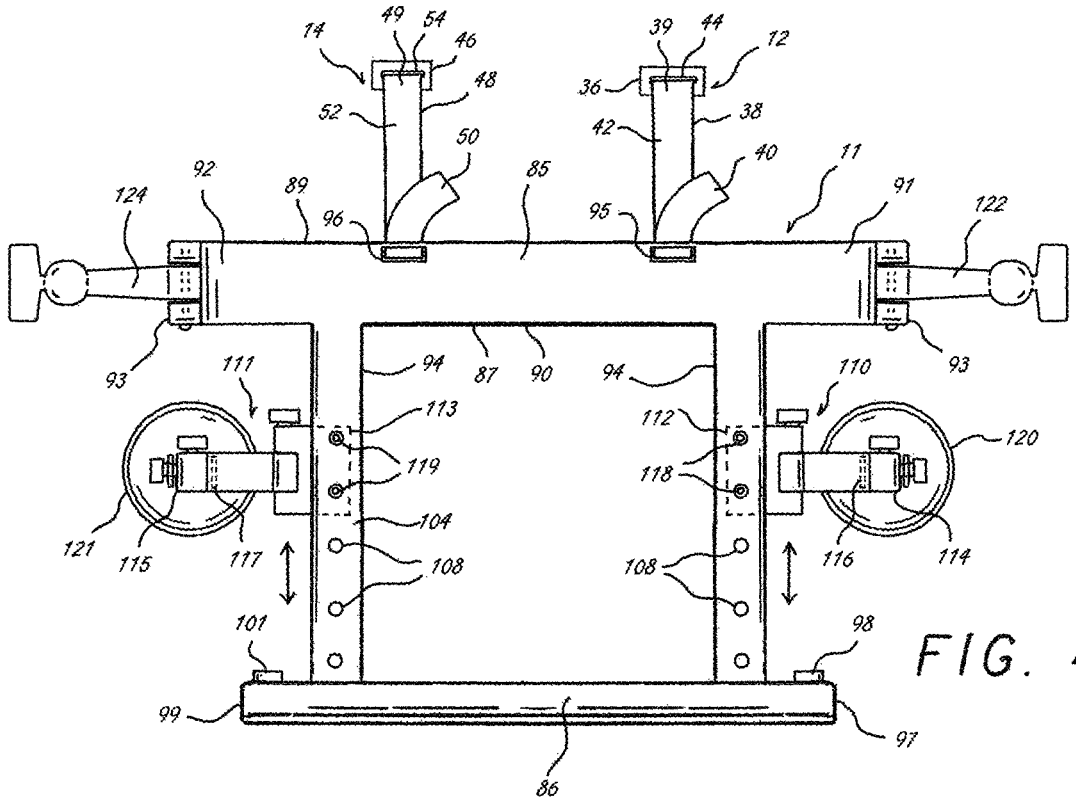
FIG. 4 is side elevational view of the receiver taken along lines 4-4 of FIG. 3.
Figure 7:
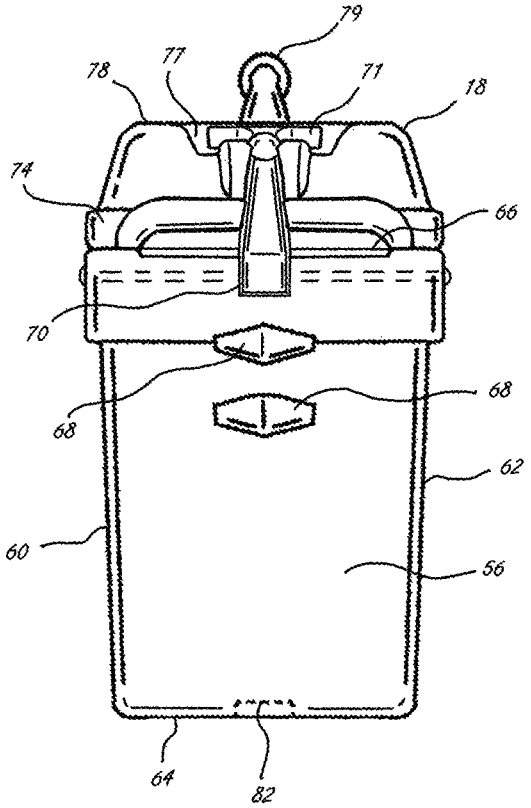
FIG. 7 is a front elevational view of the container taken along lines 7-7 of FIG. 5.

With reference now to the drawings, and in particular to FIG. 1 thereof, the preferred embodiment of the new and improved watercraft cooler system embodying the principles and concepts of the present invention and generally designated by the reference numeral 10 will be described.

The present invention, the watercraft cooler system 10, is comprised of a plurality of components. In their broadest context such include a container, a receiver, and a support member. Such components are individually configured and correlated with respect to each other so as to attain the desired objective.

In the preferred embodiment of the watercraft cooler system, designated by reference numeral 10, first provided is a personal watercraft 20 with a front end 21, a back end 22, a top end 23, and a bottom end 24. The personal watercraft further has a left side 25 and a similarly configured right side 26 defining a central vertical plane therebetween. An engine compartment 27 is formed above the bottom end and adjacent to the back end. The engine compartment has an exterior surface 28 and an upper periphery 29. A passenger seat 30 with a rectilinear shape is removably positioned above the engine compartment and engages the upper periphery. Similarly configured foot channels 31 are laterally spaced and parallel with the passenger seat.

Provided next is a first support member 12. The first support member includes a first knuckle 36 and a first strap 38. The first strap has a primary end 39 and a secondary end 40 with an intermediate region 42 therebetween. The first knuckle has a generally cylindrical body with a first rectilinear slot 44. The first rectilinear slot is disposed for receiving and securing the primary end of the first strap within the first knuckle.

Next provided is a second support member 14. The second support member includes a second knuckle 46 and a second strap 48. The second strap has a primary end 49 and a secondary end 50 with an intermediate region 52 therebetween. The second knuckle has a generally cylindrical configuration with a second rectilinear slot 54. The second rectilinear slot is disposed for receiving and securing the primary end of the second strap within the second knuckle.

Further provided is a container 16 with a generally rectilinear configuration. The container has a first wall 56 and a similarly configured second wall 58. The first wall and the second wall are laterally spaced and define a first vertical plane of symmetry therebetween. The container has a third wall 60 and a similarly configured fourth wall 62. The container further has a closed bottom 64 and an open top 66. The third wall and the fourth wall are laterally spaced and define a second vertical plane of symmetry therebetween. The first wall and the second wall have similarly configured U-shaped projections 68 in alignment with the second vertical plane of symmetry. The first wall has an upper recess 70 positioned above the U-shaped projection and adjacent to the open top. A first elastomeric latch 71 is positioned within the upper recess. The second wall has a hinge 72 positioned above the U-shaped projection and adjacent to the open top.

Next provided is a lid 18. The lid is positioned above the open top of the container. The lid has a first edge 74 and a laterally spaced second edge 76. The second edge is operably coupled to the hinge. The first edge has a closure recess 77 in alignment with the second vertical plane of symmetry. The closure recess is disposed for removably receiving the first elastomeric latch. The lid has an exterior surface 78 with a handle 79 for transporting the system. The lid further has an interior surface 80 with a rectangular gasket 81. The rectangular gasket is made from a flexible elastomer which provides a water-tight connection between the lid and the open top. An interior chamber 65 is formed between the closed bottom and the lid for containing beverages and other dry goods.

The closed bottom of the container has a forward recess 82 and a similarly configured rearward recess 84. The forward recess and the rearward recess are laterally spaced from the first vertical plane of symmetry and in alignment with the second vertical plane of symmetry. A first length is defined between the forward recess and the rearward recess. The forward recess and the rearward recess have a recess diameter. The closed bottom and the four walls of the container and the lid are formed with a thermal interior insulation 130 for insulating the interior chamber. The process of providing the interior insulation is well known in the prior art as roto-molding which creates an interior cavity within the walls for positioning insulation materials such as foam or polystyrene.

Further provided is a receiver 11 with a generally L-shaped configuration. The receiver has an upward support 85 and a horizontal base 86. The upward support has an interior surface 87, an exterior surface 88, a top edge 89, and a bottom edge 90. The upward support further has a forward end 91 and a spaced rearward end 92 which define a third vertical plane of symmetry therebetween. The forward end and the rearward end each have distal ends 93 which curve inward approximately 45-degrees, plus or minus 10 percent, towards the interior surface of the upward support. A second length is defined between the distal ends of the forward end and the rearward end of the upward support. The second length is greater than the first length.

The top edge of the upward support has a forward rectilinear slot 95 and a rearward rectilinear slot 96. The forward rectilinear slot is disposed for receiving the secondary end of the first strap and the rearward rectilinear slot is disposed for receiving the secondary end of the second strap. The horizontal base has a forward region 97 with a forward projection 98. The horizontal base also has a rearward region 99 with a rearward projection 101. The forward projection and the rearward projection are similarly configured and laterally spaced from the third vertical plane of symmetry. A third length is defined between the forward projection and the rearward projection. The third length is equal to the first length. The forward projection and the rearward projection have a projection diameter. The projection diameter is less than the recess diameter. Both the forward projection and rearward projection have a central axis which defines a fourth vertical plane of symmetry. The fourth vertical plane of symmetry is perpendicular to the third vertical plane of symmetry.

Two laterally spaced L-shaped extents 94 connect the bottom edge of the upward support to the horizontal base. Each L-shaped extent is similarly configured with an interior surface 104 and an exterior surface 106. A plurality of apertures 108 extend through the interior surface and the exterior surface of each L-shaped extent.

Provided next is a primary arm 110 with a first end 112 and a second end 114 with a joint 116 therebetween. The first end is adjustably coupled with the plurality of apertures 108 of the L-shaped extent adjacent to the forward region of the horizontal base. The first end of the primary arm includes a plurality of projections 118 for facilitating vertical adjustments of the coupled orientation with the plurality of apertures. A primary suction cup 120 is rotatably mounted to the second end of the primary arm. The primary arm provides both lateral and vertical adjustments of the primary suction cup.

secondary arm 111 is also provided. The secondary arm has a first end 113 and a second end 115 with a joint 117 therebetween. The first end of the secondary arm is adjustably coupled with the plurality of apertures of the L-shaped extent adjacent to the rearward region of the horizontal base. The first end includes a plurality of projections 119 for facilitating vertical adjustments of the coupled orientation with the plurality of apertures. A secondary suction cup 121 is rotatably mounted to the second end of the secondary arm. The secondary arm provides both lateral and vertical adjustments of the secondary suction cup.

Lastly, a second elastomeric latch 122 and a third elastomeric latch 124 are provided. The second elastomeric latch is fixed to the distal end of the forward end 91. The third elastomeric latch is fixed to the distal end of rearward end 92. Both the second elastomeric latch and the third elastomeric latch are similarly configured and have an equal latch length terminating at the fourth vertical plane of symmetry.

In the preferred embodiment, referring to FIG. 2, the receiver is universally positioned within the foot channels of the personal watercraft on either side of the central vertical plane with the exterior surface of the upward support adjacent to the engine compartment. With the receiver positioned and the passenger seat removed, the first knuckle and the second knuckle are positioned within the engine compartment with the secondary ends of both the first and second straps positioned exteriorly of the engine compartment and adjacent to the receiver. When the passenger seat is repositioned, the intermediate regions of both the first and second straps are positioned above the upper periphery and below the passenger seat thereby allowing the secondary ends of both the first and second straps to be received by the forward and rearward rectilinear slots respectively. In this manner, as is best shown in FIGS. 2 and 3, both the first support member and the second support member provide support to the receiver as a result of the first and second knuckles being contained within the engine compartment. Additionally, the primary and secondary suction cups of the primary and secondary arms are individually disposed for parallel alignment and for vertical engagement with the exterior surface of the engine compartment thereby providing even further support to the receiver within the foot channel.

As previously described, the container and the receiver are symmetrically configured for more than one receiving position. The container is positioned within the receiver in a first position with the forward recess receiving the forward projection and with the rearward recess receiving the rearward projection. The container is alternatively positioned in a second position with the forward recess receiving the rearward projection and with the rearward recess receiving the forward projection. The U-shaped projections are also symmetrically configured for both the first and second positions. The U-shaped projection of the first wall is disposed for receiving the second elastomeric latch in the first position and the third elastomeric latch in the second position. The U-shaped projection of the second wall is disposed for receiving the third elastomeric latch in the first position and the second elastomeric latch in the second position.

Figure 8:
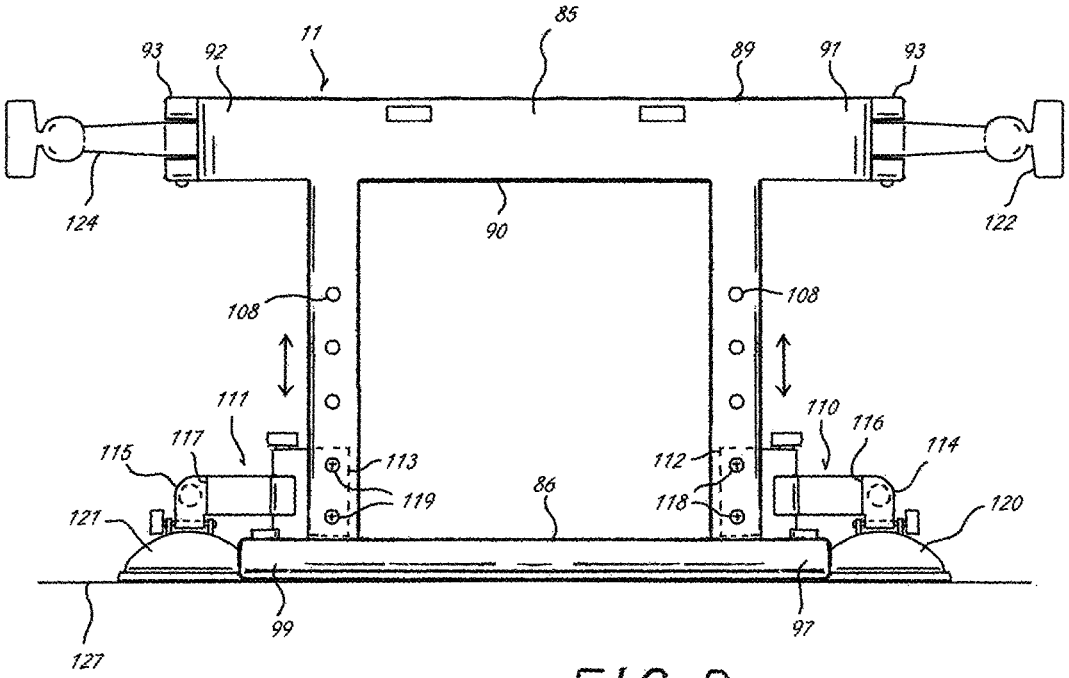
FIG. 8 is a side elevational view similar to FIG. 4 showing the receiver engaging a horizontal surface.
Figure 11:
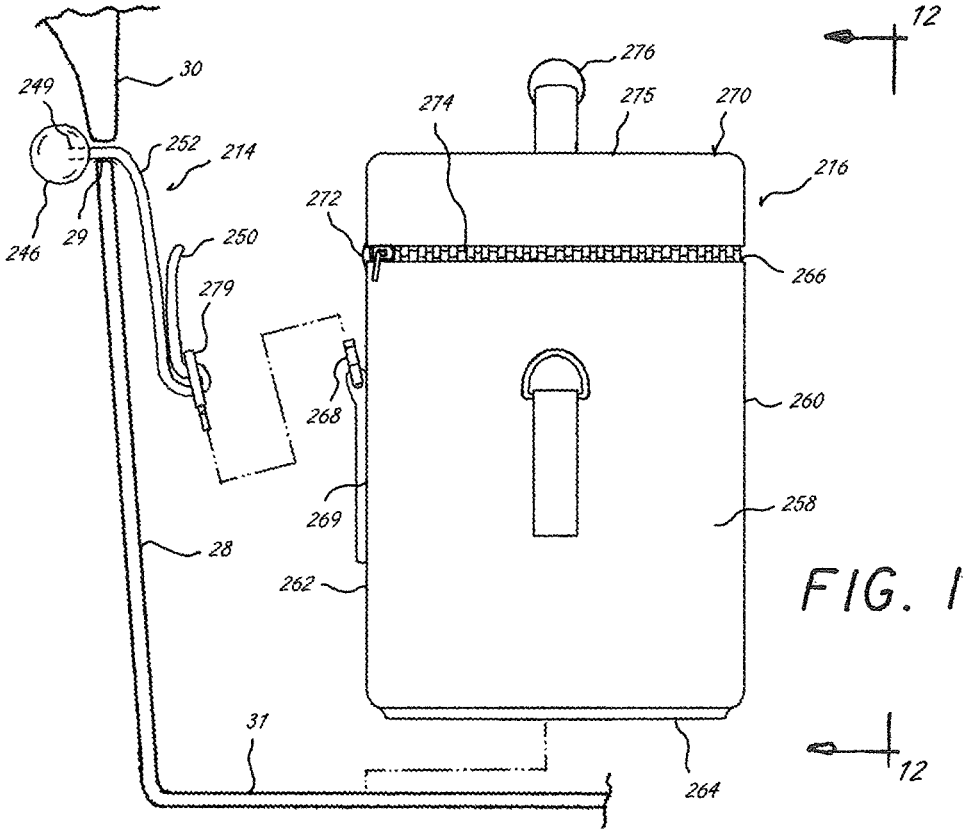
FIG. 11 is a rear elevational view of the first alternate embodiment taken along lines 11-11 of FIG. 9.
Figure 12:
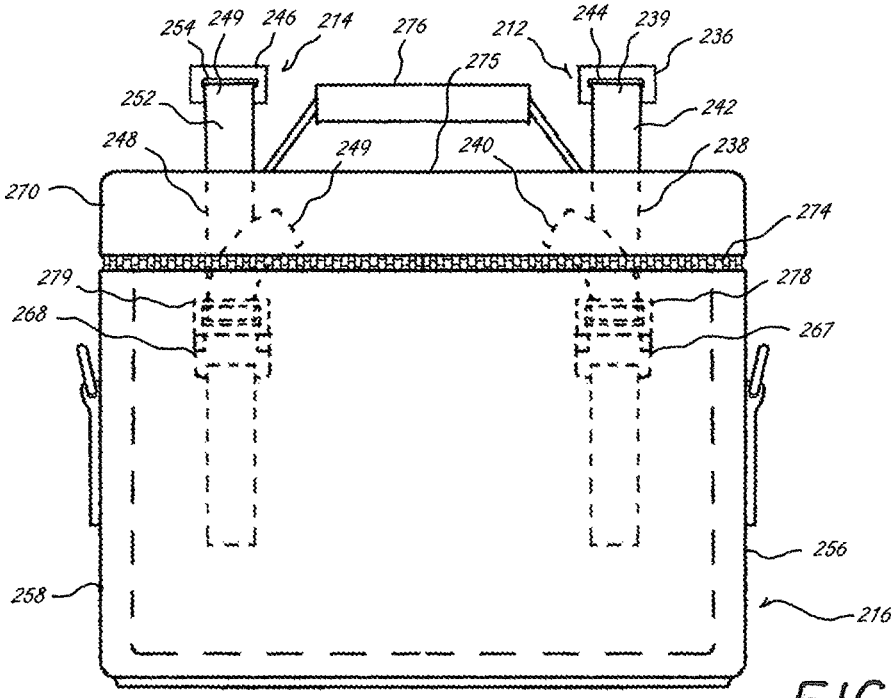
FIG. 12 is side elevational view of the first alternate embodiment taken along lines 12-12 of FIG. 11.

In the preferred embodiment, the receiver is positioned and universally mounted within the rearward foot channels of a personal watercraft for removably supporting the container. It should also be appreciated that the receiver in the preferred embodiment is not limited to engagement with vertical surfaces such as the exterior surface of the personal watercraft. Now referring to FIG. 8, the first ends of the primary and secondary arms are disposed for a lowest coupled orientation adjacent to the horizontal base, thereby allowing the primary and secondary suction cups 120, 121 to be aligned parallel with the horizontal base for lateral engagement with horizontal surfaces 127. Such horizontal surfaces may include stand-up paddle boards, kayaks, fiberglass boat decks, and/or other similar applications with horizontal surfaces which allow positioning and mounting the system.

The first alternate embodiment of the invention is shown in FIGS. 9-12 which eliminates the use of the receiver. In the first alternate embodiment of the system, designated by reference numeral 200, first provided is a third support member 212 which includes a third knuckle 236 and a third strap 238. The third strap has a primary end 239 and a secondary end 240 with an intermediate region 242 therebetween. The third knuckle has a cylindrical body with a third rectilinear slot 244 disposed for receiving and securing the primary end of the third strap within the third knuckle.

Also provided is a fourth support member 214 which includes a fourth knuckle 246 and a fourth strap 248. The fourth strap has a primary end 249 and a secondary end 250 with an intermediate region 252 therebetween. The fourth knuckle has a cylindrical configuration with a fourth rectilinear slot 254 disposed for receiving and securing the primary end of the fourth strap within the fourth knuckle.

receptacle 216 is provided next. The receptacle has a generally rectilinear configuration with a first wall 256 and a similarly configured second wall 258. The receptacle has a third wall 260 and a similarly configured fourth wall 262. The receptacle further has a closed bottom 264 and an open top 266. The fourth wall of the receptacle has a first female clasp 267 and a second female clasp 268 fixed to an exterior surface 269.

Further provided is a cover 270 which is positioned above the open top of the receptacle. An interior compartment is formed within the receptacle between the closed bottom and the cover. A living hinge 272 operably couples the cover to the fourth wall of the receptacle. The cover and the open top of the receptacle have a common periphery. A zipping member 274 is positioned along the common periphery and terminates at the living hinge. The zipping member is disposed for facilitating open and closed positions between the cover and the open top of the receptacle. The cover has an exterior surface 275 with a grip 276 for transporting the system.

A first male clasp 278 and a second male clasp 279 are provided last in the first alternate embodiment. The first male clasp 278 is slidably coupled to the secondary end of the third strap for removably receiving the first female clasp. The second male clasp 279 is slidably attached to the secondary end of the fourth strap for removably receiving the second female clasp.

In the first alternate embodiment, referring to FIG. 10, the receptacle is universally positioned within the foot channels of the personal watercraft on either side of the central vertical plane with the exterior surface of the fourth wall of the receptacle adjacent to the engine compartment. With the receptacle positioned, the passenger seat is removed and the third and fourth knuckles are positioned within the engine compartment with the secondary ends of both the third and fourth straps positioned exteriorly of the engine compartment and adjacent to the receptacle. When the passenger seat is repositioned, the intermediate regions of both the third and fourth straps are positioned above the upper periphery and below the passenger seat thereby allowing the first and second male clasps to be received by the first and second female clasps respectively. In this manner, the third and fourth support members provide support to the receptacle resulting from the third and fourth knuckles being contained within the engine.

In another alternate embodiment, interior chamber 65 includes supports 300 located interiorly and below the open top. The supports are disposed for storing beverage containers 302 in a preferred orientation.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A watercraft cooler system comprising, in combination:

a personal watercraft having a front end, a back end, a top end, and a bottom end, the personal watercraft further having a left side and a similarly configured right side, an engine compartment being formed above the bottom end and adjacent to the back end, the engine compartment having an exterior surface and an upper periphery, a passenger seat being removably positioned above the engine compartment, foot channels are laterally spaced and parallel with the passenger seat;

a first support member including a first knuckle and a first strap, the first strap having a primary end and a secondary end with an intermediate region therebetween, the primary end of the first strap terminating within the first knuckle;

a container having a first wall and a laterally spaced second wall, the container having a third wall and laterally spaced fourth wall, the container further having a closed bottom and an open top, the first wall and the second wall having U-shaped projections, the first wall having an upper recess adjacent to the open top, a first latch positioned within the upper recess, the second wall having a hinge adjacent to the open top, the closed bottom having a forward recess and a similarly configured rearward recess;

a lid being positioned above the open top and operably coupled to the hinge, the lid having a closure recess laterally spaced from the hinge and disposed for receiving the first latch, the lid having an exterior surface with a handle;

a receiver having an upward support and a horizontal base, the upward support having an interior surface, an exterior surface, a top edge, and a bottom edge, the upward support further having a forward end and a spaced rearward end, the forward end and the rearward end each having a distal end curving inwardly towards the interior surface, a second latch being fixed to the distal end of the forward end and a third latch being fixed to the distal end of the rearward end, the top edge having a first rectilinear slot, the horizontal base having a forward region with a forward projection and a rearward region with a rearward projection;

two laterally spaced L-shaped extents connecting the bottom edge of the upward support to the horizontal base, a plurality of apertures extending through an exterior surface and an interior surface of each L-shaped extent;

a primary arm having a first end and a second end with a joint therebetween, the first end being adjustably coupled with the plurality of apertures of the L-shaped extent adjacent to the forward region of the horizontal base, a primary suction cup rotatably mounted to the second end of the primary arm;

a secondary arm having a first end and a second end with a joint therebetween, the first end being adjustably coupled with the plurality of apertures of the L-shaped extent adjacent to the rearward region of the horizontal base, a secondary suction cup being rotatably mounted to the second end of the secondary arm;

the receiver being positioned within the foot channels of the personal watercraft with the exterior surface of the upward support adjacent to the exterior surface of the engine compartment;

the first knuckle being positioned within the engine compartment with the intermediate region of the first strap positioned above the upper periphery and below the passenger seat thereby positioning the secondary end exteriorly of the engine compartment adjacent to the receiver;

the forward and rearward recesses of the container being disposed for receiving the forward and rearward projections of the receiver;

the U-shaped projection of the first wall being disposed for receiving the second and third latches respectively;

the U-shaped projection of the second wall being disposed for receiving the second and third latches respectively; and the first rectilinear slot being disposed for receiving the secondary end of the first strap thereby supporting the receiver along the exterior surface of the engine compartment.

2. The system as set forth in claim 1, wherein the joints of the primary and secondary arms provide for both lateral and vertical adjustments of the primary and secondary suction cups for parallel alignment and vertical engagement with the exterior surface of the engine compartment.

3. The system as set forth in claim 1, wherein the container is positioned within the receiver in a first position with the forward recess receiving the forward projection and with the rearward recess receiving the rearward projection.

4. The system as set forth in claim 1, wherein the container is positioned within the receiver in a second position with the forward recess receiving the rearward projection and with the rearward recess receiving the forward projection.

5. The system as set forth in claim 1, wherein the first ends of the primary and secondary arms are disposed for facilitating vertical adjustments of the coupled orientation with the plurality of apertures of the L-shaped extents.

6. The system as set forth in claim 1, wherein the first ends of the primary and secondary arms are disposed for a lowest coupled orientation adjacent to the horizontal base thereby allowing parallel alignment and lateral engagement of the primary and secondary suction cups with horizontal surfaces.

7. A watercraft cooler system for being universally mounted within rearward foot channels of a personal watercraft and for removably supporting an insulated container adapted for storage of beverages and other dry goods, the system comprising, in combination:

the personal watercraft having front end, a back end, a top end, and a bottom end, the personal watercraft further having a left side and a similarly configured right side defining a central vertical plane therebetween, an engine compartment formed above the bottom end and adjacent to the back end, the engine compartment having an exterior surface and an upper periphery, a passenger seat having a rectilinear shape being removably positioned above the engine compartment for engaging the upper periphery, similarly configured foot channels laterally spaced and parallel with the passenger seat;

a first support member including a first knuckle and a first strap, the first strap having a primary end and a secondary end with an intermediate region therebetween, the first knuckle having a cylindrical body with a first rectilinear slot disposed for receiving and securing the primary end of the first strap within the first knuckle;

a second support member including a second knuckle and a second strap, the second strap having a primary end and a secondary end with an intermediate region therebetween, the second knuckle having a cylindrical configuration with a second rectilinear slot disposed for receiving and securing the primary end of the second strap within the second knuckle;

a container having a generally rectilinear configuration, the container having a first wall and a similarly configured second wall, the first wall and the second wall being laterally spaced and defining a first vertical plane of symmetry therebetween, the container having a third wall and a similarly configured fourth wall, the container further having a closed bottom and an open top, the third wall and the fourth wall being laterally spaced and defining a second vertical plane of symmetry therebetween, the first wall and the second wall having similarly configured U-shaped projections in alignment with the second vertical plane of symmetry, the first wall having an upper recess above the U-shaped projection and adjacent to the open top, a first elastomeric latch positioned within the upper recess, the second wall having a hinge above the U-shaped projection and adjacent to the open top;

the container further including a lid positioned above the open top, the lid having a first edge and a laterally spaced second edge, the second edge being operably coupled to the hinge, the first edge having a closure recess in alignment with the second vertical plane of symmetry, the closure recess is disposed for removably receiving the first elastomeric latch, the lid having an exterior surface with a handle, the lid having an interior surface with a rectangular gasket providing a watertight connection between the lid and the open top;

the closed bottom having a forward recess and a similarly configured rearward recess, the forward recess and the rearward recess being spaced from the first vertical plane of symmetry and in alignment with the second vertical plane of symmetry, a first length being defined between the forward recess and the rearward recess, the forward recess and the rearward recess having a recess diameter;

a receiver having a generally L-shaped configuration, the receiver having an upward support and a horizontal base, the upward support having an interior surface, an exterior surface, a top edge, and a bottom edge, the upward support further having a forward end and a spaced rearward end defining a third vertical plane of symmetry therebetween, the forward end and the rearward end each having a distal end curving inward approximately 45-degrees, plus or minus 10 percent, towards the interior surface of the upward support, a second length being defined between the distal ends of the forward end and the rearward end, the second length being greater than the first length;

the top edge of the upward support having a forward rectilinear slot and a rearward rectilinear slot, the horizontal base having a forward region with a forward projection and a rearward region with a rearward projection, the forward projection and the rearward projection being similarly configured and spaced from the third vertical plane of symmetry, a third length being defined between the forward projection and the rearward projection, the third length being equal to the first length, the forward projection and the rearward projection having a projection diameter, the projection diameter being less than the recess diameter, both the forward projection and rearward projection having a central axis defining a fourth vertical plane of symmetry, the fourth vertical plane of symmetry being perpendicular to the third vertical plane of symmetry; two laterally spaced L-shaped extents connecting the bottom edge of the upward support to the horizontal base, each L-shaped extent being similarly configured and having an interior surface and an exterior surface, a plurality of apertures extending through the exterior surface and the interior surface of each L-shaped extent;

a primary arm having a first end and a second end with a joint therebetween, the first end being adjustably coupled with the plurality of apertures of the L-shaped extent adjacent to the forward region of the horizontal base, the first end of the primary arm including a plurality of projections for facilitating vertical adjustments of the coupled orientation with the plurality of apertures, a primary suction cup being rotatably mounted to the second end of the primary arm;

a secondary arm having a first end and a second end with a joint therebetween, the first end being adjustably coupled with the plurality of apertures of the L-shaped extent adjacent the rearward region of the horizontal base, the first end including a plurality of projections for facilitating vertical adjustments of the coupled orientation with the plurality of apertures, a secondary suction cup being rotatably mounted to the second end of the secondary arm;

a second elastomeric latch fixed to the distal end of forward end, a third elastomeric latch being fixed to the distal end of rearward end, both the second elastomeric latch and the third elastomeric latch being similarly configured and having equal latch lengths terminating at the fourth vertical plane of symmetry;

the receiver being positioned within the foot channels of the personal watercraft with the exterior surface of the upward support adjacent to the engine compartment;

the first knuckle and the second knuckle being positioned within the engine compartment with the intermediate regions of both the first and second straps positioned above the upper periphery and below the passenger seat thereby positioning the secondary ends exteriorly of the engine compartment adjacent to the receiver;

the joints of the primary and secondary arms providing both lateral and vertical adjustments of the primary and secondary suction cups for parallel alignment and vertical engagement with the exterior surface of the engine compartment;

the first ends of the primary and secondary arms being disposed for a lowest coupled orientation adjacent to the base thereby allowing parallel alignment and lateral engagement of the primary and secondary suction cups with horizontal surfaces;

the container being positioned within the receiver in a first position with the forward recess receiving the forward projection and with the rearward recess receiving the rearward projection;

the container being positioned within the receiver in a second position with the forward recess receiving the rearward projection and with the rearward recess receiving the forward projection;

the U-shaped projection of the first wall being disposed for receiving the second elastomeric latch in the first position and the third elastomeric latch in the second position;

the U-shaped projection of the second wall being disposed for receiving the third elastomeric latch in the first position and the second elastomeric latch in the second position; and the forward rectilinear slot being disposed for receiving the secondary end of the first strap and the rearward rectilinear slot is disposed for receiving the secondary end of the second strap thereby supporting the receiver along the exterior surface of the engine compartment.

8. A watercraft cooler system for being universally mounted within rearward foot channels of a personal watercraft and for removably supporting an insulated container adapted for storage of beverages and other dry goods, the system comprising, in combination:

the personal watercraft having front end, a back end, a top end, and a bottom end, the personal watercraft further having a left side and a similarly configured right side defining a central vertical plane therebetween, an engine compartment being formed above the bottom end and adjacent to the back end, the engine compartment having an exterior surface and an upper periphery, a passenger seat having a rectilinear shape being removably positioned above the engine compartment for engaging the upper periphery, similarly configured foot channels laterally spaced and parallel with the passenger seat;

a third support member including a third knuckle and a third strap, the third strap having a primary end and a secondary end with an intermediate region therebetween, the third knuckle having a cylindrical body with a third rectilinear slot disposed for receiving and securing the primary end of the third strap within the third knuckle;

a fourth support member including a fourth knuckle and a fourth strap, the fourth strap having a primary end and a secondary end with an intermediate region therebetween, the fourth knuckle having a cylindrical configuration with a fourth rectilinear slot disposed for receiving and securing the primary end of the fourth strap within the fourth knuckle;

a receptacle having a generally rectilinear configuration, the receptacle having a first wall and a similarly configured second wall, the receptacle having a third wall and a similarly configured fourth wall, the receptacle further having a closed bottom and an open top, the fourth wall having a first female clasp and a second female clasp fixed to an exterior surface;

the receptacle further including a cover positioned above the open top, a living hinge operably coupling the cover to the fourth wall of the receptacle, the cover and the open top having a common periphery, a zipping member provided along the common periphery, the zipping member being disposed for facilitating open and closed positions between the cover and the open top of the receptacle, the cover having an exterior surface with a grip;

a first male clasp slidably attached to the secondary end of the third strap and a second male clasp being slidably attached to the secondary end of the fourth strap;

the receptacle being positioned within the foot channels of the personal watercraft with the exterior surface of the fourth wall adjacent to the engine compartment;

the third knuckle and the fourth knuckle being positioned within the engine compartment with the intermediate regions of both the third and fourth straps positioned above the upper periphery and below the passenger seat thereby positioning the first and second male clasps exteriorly of the engine compartment adjacent to the receptacle; and the first male clasp being disposed for removably receiving the first female clasp, the second male clasp being disposed for removably receiving the second female clasp thereby supporting the receptacle along the exterior surface of the engine compartment.

* * * * *